US006041458A

United States Patent [19]

Vickers et al.

[11] Patent Number: 6,041,458

[45] Date of Patent: Mar. 28, 2000

[54] TUBULAR PILLOW WITH CASING AND METHOD OF COVERING

[76] Inventors: Mark B. Vickers; Eric E. Vickers, both of 1400A Mt. Carmel Church Rd., Chapel Hill, N.C. 27514; Phreddie D. Popp, 2617 Mt. Gilead Church Rd., Pittsboro, N.C. 27312

[21] Appl. No.: 09/252,390

[22] Filed: Feb. 18, 1999

[51] Int. Cl.[7] ..... A47G 9/00

[52] U.S. Cl. ..... 5/636; 5/646; 5/490

[58] Field of Search ..... 5/636, 639, 640, 5/643, 646, 490

[56] References Cited

U.S. PATENT DOCUMENTS

| | | | |
|---|---|---|---|
| D. 315,845 | 4/1991 | Lafley | D6/601 |
| 2,877,472 | 3/1959 | Wagner | 5/636 |
| 3,848,281 | 11/1974 | Mathews | 5/636 |
| 5,159,727 | 11/1992 | McCracken | 5/655 |
| 5,579,551 | 12/1996 | Tommaney | 5/636 |
| 5,584,086 | 12/1996 | Van Winkle et al. | 5/636 |
| 5,604,944 | 2/1997 | Meade | 5/643 |
| 5,644,809 | 7/1997 | Olson | 5/636 |

*Primary Examiner*—Alexander Grosz
*Attorney, Agent, or Firm*—Olive & Olive, P.A.

[57] ABSTRACT

The present invention provides a tubular pillow including a cover tube and method for enclosing the inside and outside surfaces thereof. The tubular pillow has a tubular body formed of a soft and resilient material with a central tunnel passing through longitudinally. The cover tube is a fabric tube having closure elements preferably of the snap fastener type. The cover tube is mounted onto the tubular body by passing through the central tunnel and bringing each end of the cover tube around the tubular body with a set of snap fasteners engaging a complementary set of snap fasteners on the tubular body. In a second embodiment, the cover tube has a set of closure elements mounted on each end, configured and mounted so as to connect to each other. When the cover tube is assembled to the tubular body, the tubular pillow of the invention simulates the appearance of a conventional pillow.

15 Claims, 4 Drawing Sheets

TUBULAR PILLOW WITH CASING AND METHOD OF COVERING

FIELD OF THE INVENTION

The present invention relates to the field of pillows, and more particularly to a pillow having a tubular passage therethrough and a removably mountable casing therefor.

BACKGROUND OF THE INVENTION

A pillow is typically a fabric bag stuffed with a soft material. Conventional pillows generally provide a soft cushion on which to place one's head while resting or sleeping, either in bed, or on upholstered furniture in which case the pillows typically have a permanent fabric cover.

Pillows are used in various ways. Some people have developed a habit of placing an arm beneath the pillow to raise their head to a more comfortable position. When two people share a bed or couch, one person often places an arm directly beneath the head of the other person. This gesture of closeness, while basically affectionate, has the drawback of causing discomfort and stiffness to the arm because of reduced circulation from the pressure of the other person's head. As an alternative, the first person may place his or her arm under a pillow on which the second person is resting his or her head. This alternative, however, still has the disadvantage of discomfort and stiffness caused by the pressure between one person's arm and underlying support surface that may be a hard floor.

The present invention recognizes that a solution can be achieved by forming a pillow in a tubular configuration adapted for inserting one's arm and supporting one's own head or one's partner's head. This improvement in comfort benefits both individuals when a pillow is being shared. The use of a pillow on the arm of one individual and beneath the head of the other partner maintains cushioning between the body parts, thus absorbing body pressure between head and arm. It is further recognized that such a tubular pillow provides significant benefits when one is reclining on a couch with a partner or relaxing on the floor, as in watching television or listening to music.

It is further recognized that, as with ordinary bed linens, it is periodically necessary to wash fabrics that become soiled due to repeated contact with body surfaces and oils. For example, a conventional pillow case is easily removed from the pillow for washing. However, a conventional pillow case will not suffice as a cover for a tubular pillow, because it only has an opening at one end. It is recognized by the present invention that a cover for a tubular pillow must allow the arm of a person to extend through both open ends of the tubular pillow, protect the inner and outer pillow surfaces from direct body contact, and also be easily removed for washing.

A number of pillows having arm receiving openings are known in the prior patent art. One such patent is U.S. Pat. No. 3,883,906 to Sumpter for a Sleeping Pillow With Arm Openings. The pillow disclosed by the Sumpter patent has a pair of tunnel-like openings for receiving both arms of a sleeper. The arm receiving openings are positioned on either end of the pillow with a pillow area left between the openings to support the head of the sleeper. One disadvantage of the Sumpter pillow is that the user must sleep while lying face down in a prone position. In addition, the Sumpter pillow cannot be used to support the head of a partner.

A number of patents have been issued for inventions providing a form of cushioned arm band that is intended primarily for the purpose of supporting the head of an infant during feeding. Typical of these patents are U.S. Pat. No. 4,393,520 to Koch and U.S. Pat. No. 5,440,769 to Thomas.

These patents disclose arm band inventions in which the band is fitted snugly to the arm and covers only a small length of the arm, typically around the elbow.

U.S. Pat. No. 5,239,717 to Sue teaches a Pillow For Arm Of Person Holding A Child. The disclosure of this invention provides a pillow that covers the arm of the person in the area of the elbow. A pillow cover, shown in FIG. 3 as number 19, is placed over the pillow to provide a removable, washable, outside cover. This patent does not, however, teach or suggest a cover to protect both the inner and outer surfaces of the pillow.

None of the known prior art patents provides a tubular pillow configured to loosely surround substantially the length of a person's arm while comfortably supporting the head of another person. Nor does any prior patent disclose or suggest an enhanced bed pillow for use by an individual by placing one or both arms in its central tunnel while resting his or her head on the pillow upper surface. Neither does the known prior art provide such a pillow with a removable protective tubular covering.

Therefore, it is an object of the present invention to provide a tubular pillow having a single passage through its center.

It is a further object of the present invention to provide a tubular pillow that loosely encloses a substantial portion of one or both of a user's arms.

It is an additional object of the present invention to provide a tubular pillow that cushions an arm within a central passage while a head rests on an upper surface thereof.

It is a still further object of the present invention to provide a removeably mountable covering for a tubular pillow that is configured to cover and protect the inside and the outside surfaces of the tubular pillow.

It is yet another object of the present invention to provide a tubular pillow and a covering, tube therefor that are each configured to be removeably, affixed to one another.

It is a further object of the present invention to provide a method for covering a tubular pillow.

It is a further object of the present invention to emulate the appearance of a conventional bed pillow or couch cushion.

These and other objects of the present invention will become more apparent from the following description and appended claims.

SUMMARY OF THE INVENTION

The tubular pillow of the present invention has a tubular body formed of a soft and resilient material in a fabric shell. The tubular pillow includes a cover tube that is passed through the central tunnel of the tubular body and wraps around the outer portions thereof to completely enclose the tubular body. The cover tube is slightly longer than double the pillow length so as to enclose the inner and outer surfaces of the tubular body with a portion of fabric draping beyond the end of the tubular body to create the appearance of a standard pillow case. In one embodiment the cover tube is removeably attached to the tubular body. In another embodiment, a first end of the cover tube is connected to a second end thereof, without the cover tube being attached to the tubular body.

BRIEF DESCRIPTION OF THE DRAWINGS

In order that the invention will become more clearly understood it will be disclosed below in greater detail with reference to the accompanying drawings, in which.

DESCRIPTION OF THE INVENTION AND PREFERRED EMBODIMENTS THEREOF

Figure 1:
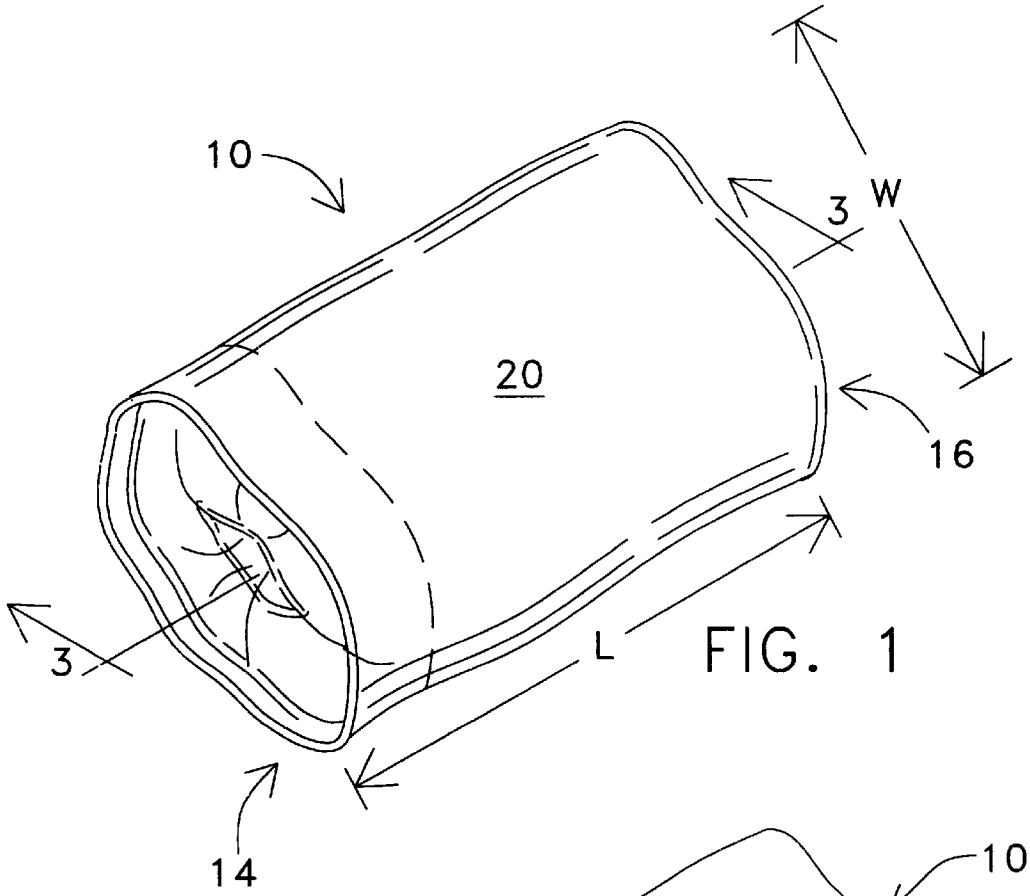
FIG. 1 is a perspective view of the tubular pillow of the present invention including a cover tube to completely cover both the exterior and interior of the tubular body.

Referring now to FIG. 1, tubular pillow 10 of the present invention extends from first end 14 to second end 16. As a replacement for a standard sized bed pillow, tubular pillow 10 has a length L of approximately 66 cm (26 inches), and a width W of approximately 53 cm (21 inches). The size and shape of tubular pillow 10 is such that a conventional style pillow case may also be used therewith as opposed to use with cover tube 20. Other sizes of tubular pillow as a replacement for a queen sized or a king sized pillow would be proportionally longer than length L.

Tubular pillow 10 may be configured with different dimensions and different shape than that illustrated herein for use with upholstered furniture, such as a couch.

Figure 2:
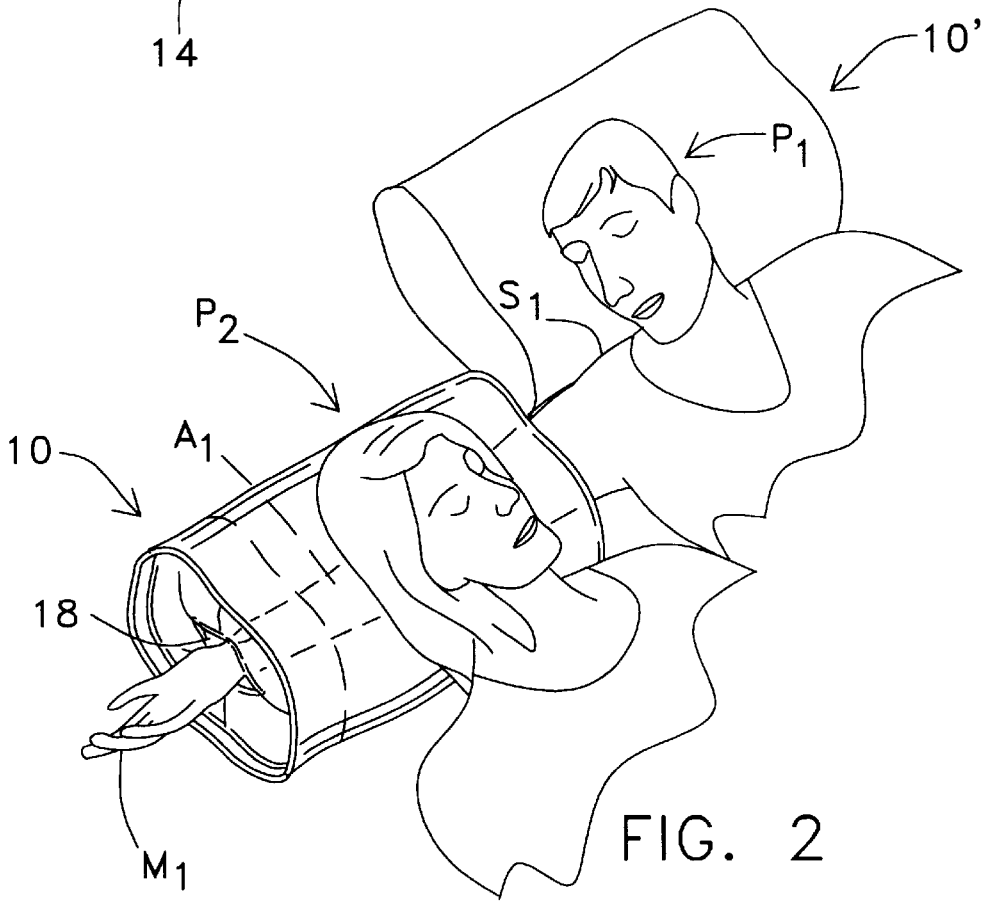
FIG. 2 is a pictorial view of the tubular pillow of the present invention as being used by two people.

FIG. 2 shows tubular pillow 10, of the present invention, as it is typically used by a first person $P_1$ and a second person $P_2$. First person $P_1$ has arm $A_1$ placed through central tunnel 18 of tubular pillow 10, with shoulder $S_1$ and hand $M_1$ visible on opposite ends of tubular pillow 10. The head of second person $P_2$ is resting on the upper surface of tubular pillow 10. The weight of the head of second person $P_2$ is felt as a gentle pressure through tubular pillow 10 on arm $A_1$, and the support of arm $A_1$ is felt under the head of second person $P_2$ without the intense pressure often associated with a direct contact of a head supported on an arm of another. Similarly, the lesser amount of cushioning thickness between the body parts, as compared with a conventional pillow, allows a more positive degree of mutual contact to be transmitted between first person $P_1$ and second person $P_2$. The tubular configuration of tubular pillow 10 also provides cushioning between the arm and the supporting surface on which it rests. If that is a hard surface, this cushioning is most comfortable. Furthermore, the tubular configuration of tubular pillow 10 allows movement of arm $A_1$ within central tunnel 18.

As described above, tubular pillow 10 of the invention may be beneficially used by a couple or by an individual. The individual benefits by inserting one or both arms into the central tunnel and resting his or her head o n th e external surface of the tubular pillow provided (not shown). The benefits to the couple are shown in FIG. 2 where the arm of a first partner is inserted through the central tunnel of the tubular pillow while the second partner rests his or her head on the top surface thereof. The weight of the head creates a pleasant pressure to the aim of the other person without the discomfort frequently associated with a head resting directly on an arm over a period of time. In addition, the head of the second partner feels the presence and movement s of the other partner's arm while having the cushioning support of a pillow.

Figure 3:
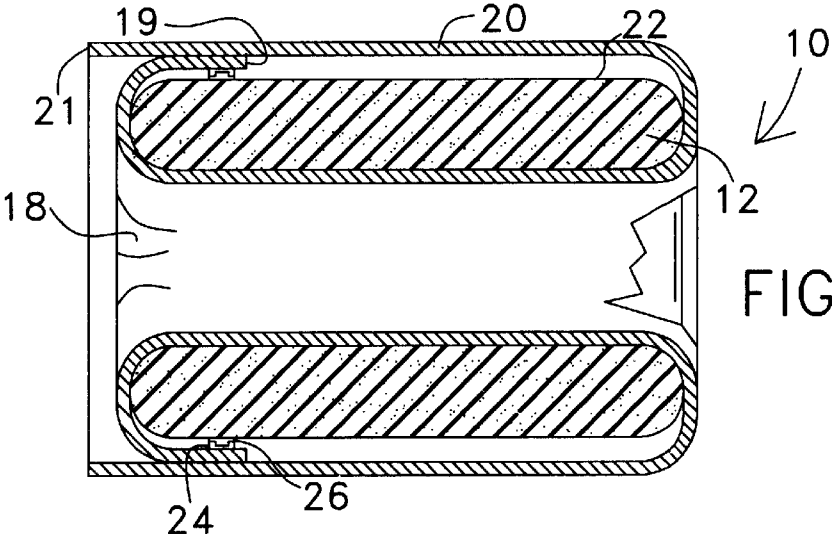
FIG. 3 is a cross sectional view of the tubular pillow taken in the direction of line 3—3 of FIG. 1 and illustrating the first embodiment of the invention.

Referring now to FIG. 3, tubular body 12 of tubular pillow 10 is formed as a generally cylindrical tube filled with a stuffing material that is somewhat soft and moderately resilient. Since tubular body 12 is not rigid, in its relaxed state it appears as an ellipsoid in end view so as to simulate the shape of a conventional bed pillow. Central tunnel 18 is axially oriented substantially parallel to the direction of length L (see FIG. 1). It is recognized that length L is long enough for central tunnel 18 to substantially encompass the arm of an average person from shoulder to hand as described above in relation to FIG. 2. A replaceable cover tube 20 passes through central tunnel 18 and wraps over and around the exterior of tubular body 12 so that first end 19 engages second end 21 as seen in FIG. 3. Second end 21 falls loosely about the first end 14 of tubular body 12.

Referring still to FIG. 3, tubular body 12 is preferably made of a tubular fabric shell 22 that has been filled with a soft, resilient material. The soft, resilient, material of tubular body 12 may be synthetic fibers, foamed plastic, feathers, or other materials adapted to serve as cushioning. Tubular body 12 hereinafter refers to the resilient material and the fabric shell 22 in which it is contained.

Referring further to FIG. 3, unitary cover tube 20 is shown passing completely through central tunnel 18 and wrapped around the exterior of tubular body 12. Cover tube 20, according to the preferred embodiment of the invention, is formed from a rectangular piece of fabric by connecting two opposed parallel edges to each other, for example by stitching. Alternatively, cover tube 20 may be formed as an integral tube, for example by circular knitting. Cover tube 20 is provided as a separate component of the present invention so as to be readily removable from tubular body 12 for cleaning purposes. Fabrics are generally made with a face side that is intended to be exposed, and a back side that is intended to be hidden. In the case of a printed fabric, the pattern is printed on the face side. The face side of the fabric is visible when cover tube 20 is wrapped around tubular body 12.

Figure 4:
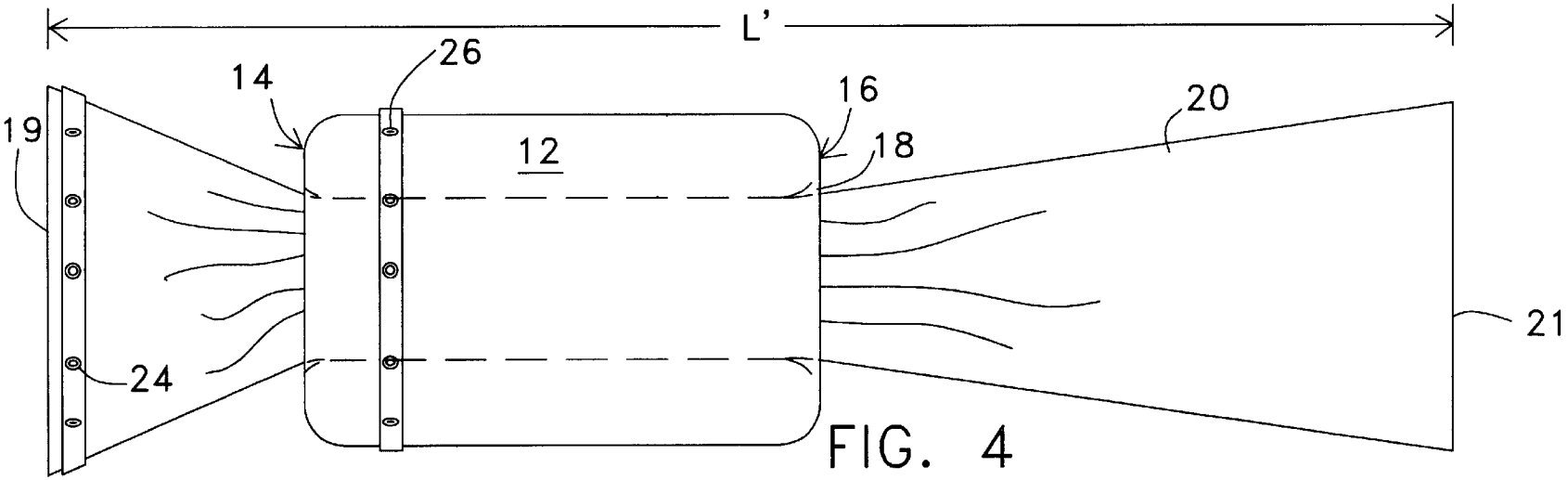
FIG. 4 is a side view of the tubular pillow of FIG. 3 and illustrating the cover tube of the first embodiment passing through and extending linearly out of both ends of the tubular body.

Referring now to FIG. 4, the length L' of cover tube 20 is greater than double the length L of tubular body 12 (see FIG. 1) to allow complete enclosure of the interior and exterior thereof with a selected amount of overlap. In extended condition, cover tube 20 is inverted so that the back side of the fabric is visible. When its ends are wrapped around tubular body 12, the face side of the fabric is seen. First end 19 of cover tube 20 has engaging closure elements 24 mounted to the exposed back side of the fabric. Receiving closure elements 26 are mounted to an outer surface of tubular body 12 in locations to engage closure elements 24 when cover tube 20 is wrapped over first end 14 of tubular body 12. Engaging closure elements 24 and receiving closure elements 26 are formed to releasably connect to each other. A preferred type of closure elements 24 and 26 is known as a snap fastener, typically supplied assembled in a spaced series on a fabric tape (shown but not numbered) for ease of handling. Alternative types of closures are buttons and holes, or a closure element commonly known by its trademark as Velcro®. After engaging closure elements 24 are brought into contact with receiving closure elements 26, cover tube 20 is draped up and around to completely enclose tubular body 12 while maintaining tunnel 18 open from first end 14 to second end 16.

According to the invention, it is preferred that engaging closure elements 24 are positioned comparatively close to first end 19 of cover tube 20 as shown in FIG. 4. Cover tube 20 may have a uniform diameter from first end 19 to second end 21 that is sufficient to encompass tubular body 12. In an alternate configuration (not shown), cover tube 20 may have a smaller diameter for the portion thereof intended to be placed within central tunnel 18 of tubular body 12 and a larger diameter for the portion intended to be placed around tubular body 12.

Figure 5:
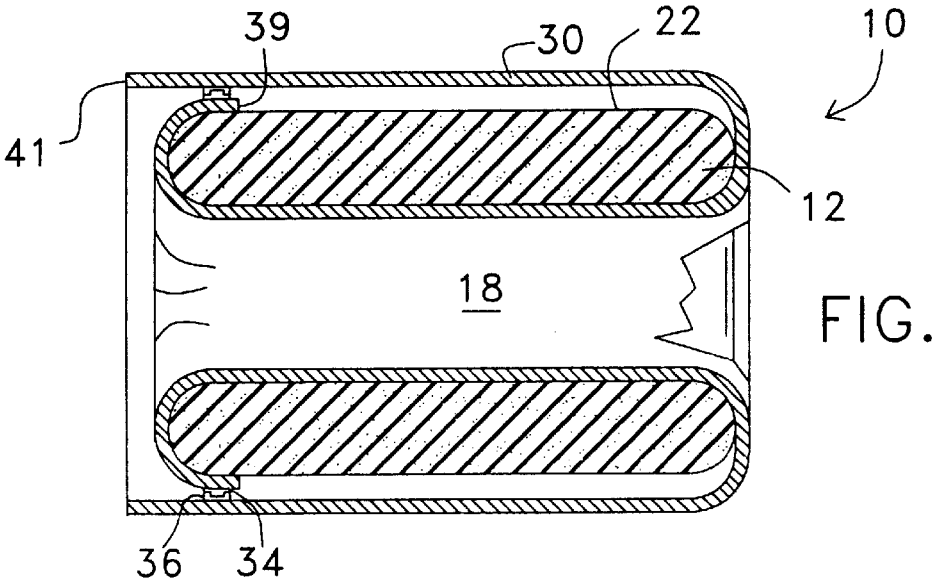
FIG. 5 is a cross sectional view of the tubular pillow, similar to that of FIG. 3, and illustrating the second embodiment of the invention.
Figure 6:
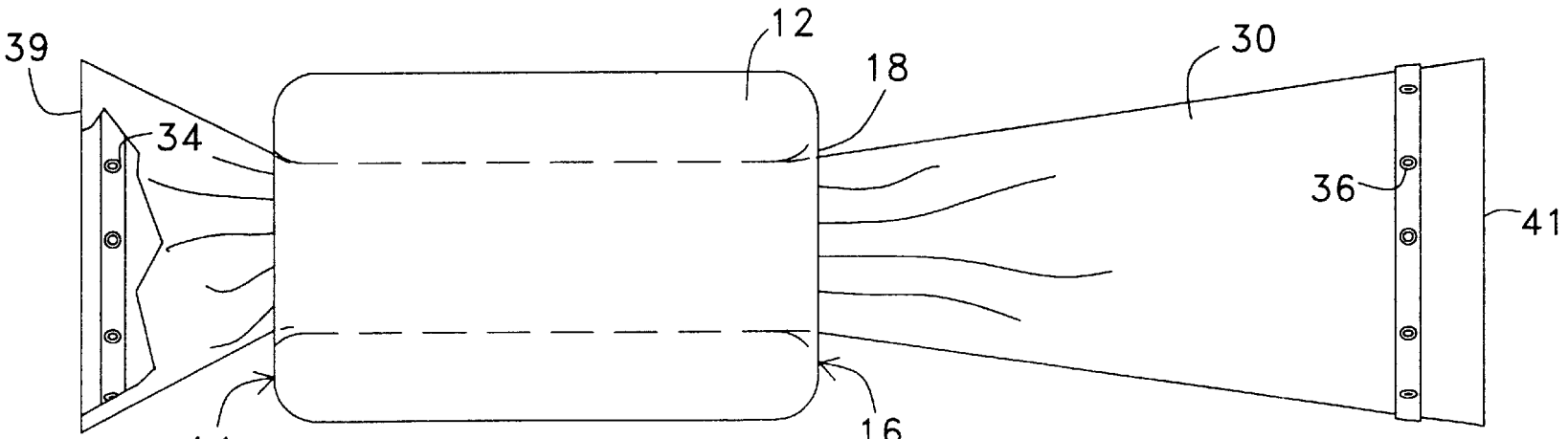
FIG. 6 is a side view of the tubular pillow of FIG. 5 and illustrating the cover tube of the second embodiment passing through and extending linearly out of both ends of the tubular body.
Figure 7:
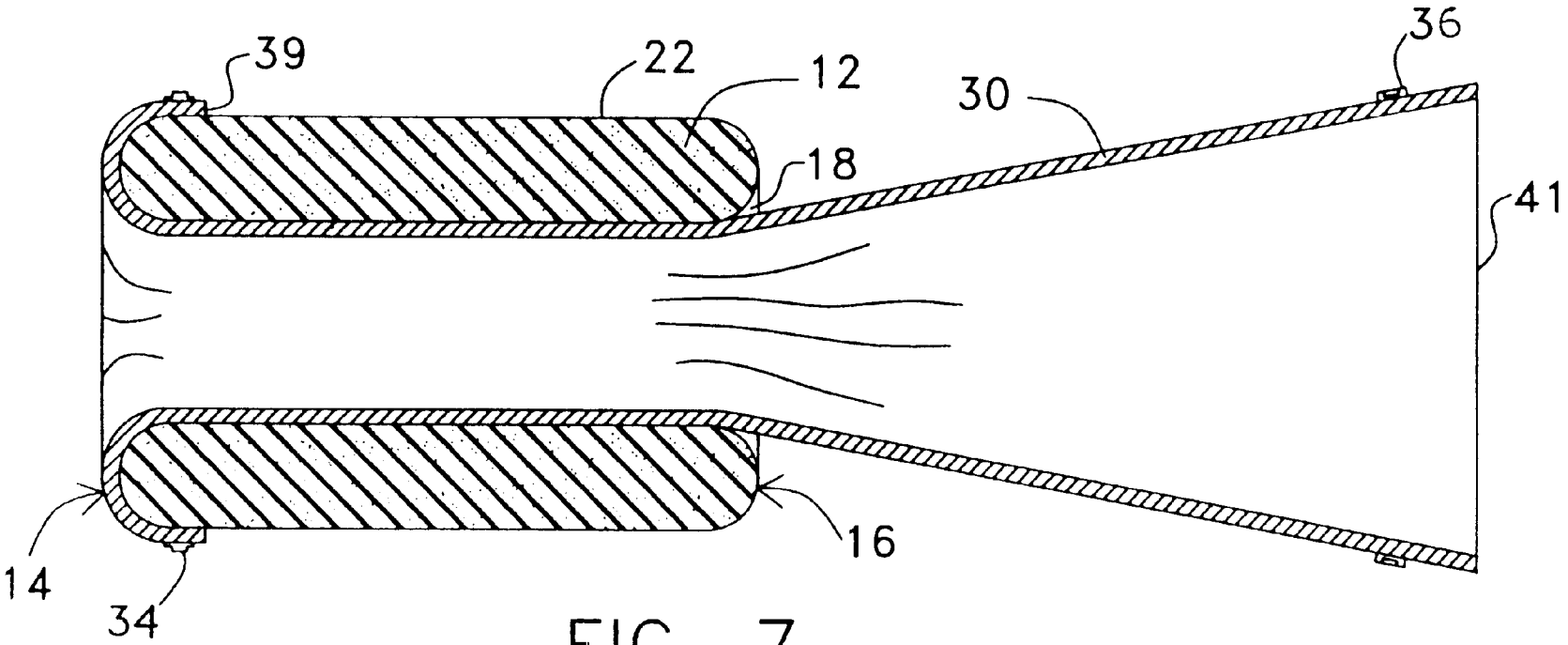
FIG. 7 is a cross sectional view of the second embodiment of the present invention and illustrating the cover tube partially enclosing a first end of the tubular body.

The first embodiment of the invention, illustrated in FIGS. 7. and 4, shows cover tube 20 releasably attached to tubular body 12. FIGS. 5 and 6 illustrate a second embodiment of the invention in which first end 39 of cover tube 30 is releasably attached to second end 41 thereof.

Referring now to FIGS. 5, 6 and 7, cover tube 30 is inverted and passes through central tunnel 18 of tubular body 12. There are no closure elements mounted on tubular body 12. Receiving closure elements 34 are mounted on the face side of the fabric at first end 39 of cover tube 30. Engaging closure elements 36 are mounted on the back side of the fabric proximal to second end 41 of cover tube 30. As first end 39 is wrapped up and around first end 14 of tubular body 12, receiving elements 34 become re-inverted to appear on the external surface of wrapped cover tube 30 as shown best in FIG. 7. Next, second end 41 of cover tube 30 is wrapped up and around second end 16 of tubular body 12. Second end 41 is pulled across the length of tubular body 12 and closure elements 34 and 36 are mated to enclose tubular body 12. The excess fabric of cover tube 30 from closure elements 36 to second end 41 is allowed to drape in relaxed fashion.

While the invention has been described with reference to specific embodiments thereof, it will be appreciated that numerous variations, modifications, and enhancements are therefore regarded as being within the spirit and scope of the invention that is only limited by the claims to follow.

What is claimed is:

1. A tubular pillow, comprising:

(a) a tubular body of a selected length and having a central tunnel of sufficient length to contain the extended arm of an average person extending longitudinally therethrough; and (b) a unitary removable cover tube for said tubular body having a length at least twice the selected length of said tubular body, said cover tube configured for passing through said central tunnel and passing outwardly around said tubular body.

2. The tubular pillow as claimed in claim 1, further comprising a first closure element on said tubular body and a second closure clement on said cover tube in a manner to be mutually engaged when said cover tube is assembled to said tubular body.

3. The tubular pillow as claimed in claim 2, wherein said first and second closure elements are formed of complementary snap fasteners.

4. The tubular pillow as claimed in claim 1, further comprising first and second closure elements mounted on opposite ends of said cover tube in a manner to be mutually engaged when said cover tube is assembled to said tubular body.

5. The tubular pillow as claimed in claim 4, wherein said first closure element is mounted externally to said cover tube and second closure element is mounted internally thereto.

6. The tubular pillow as claimed in claim 1, wherein said cover tube is formed of a substantially rectangular piece of fabric with two opposed linear edges thereof connected together.

7. The tubular pillow as claimed in claim 1, wherein said tubular body is formed of a substantially soft and resilient material.

8. A cover tube adapted to enclose a tubular body of a tubular pillow, said cover tube comprising:

(a) a tubular fabric configured to pass through a central tunnel of said tubular body and having a length sufficient to cover the inside surface and the outside surface of said tubular body;

(b) a first closure element assembled to a first end of said tubular fabric; and adapted to engage a second closure element; and (c) said second closure element being assembled to a second end of said tubular fabric and adapted to engage said first closure element to enclose said tubular body.

9. The cover tube for use with a tubular pillow as claimed in claim 8, wherein said first and second closure elements are complementary portions of a snap fastener.

10. The cover tube as claimed in claim 8, wherein said cover tube is formed of a substantially rectangular piece of fabric with two opposed linear edges thereof connected together.

11. The cover tube for use with a tubular pillow as claimed in claim 8, wherein said tubular fabric is formed by circular knitting.

12. A method of covering a tubular pillow having a tubular body with a central tunnel passing therethrough, comprising the steps of:

(a) providing a fabric tube having a first open end and a second open end;

(b) providing a first closure element on said first open end and a second closure element adapted to engage said first closure element to secure said fabric tube when assembled around said tubular body;

(c) passing said fabric tube through said central tunnel in said tubular pillow so that each said first open end and said second open end extends linearly beyond said tubular pillow;

(d) covering a first open end of said tubular pillow with said first open end of said fabric tube;

(e) covering a second open end of said tubular pillow with said second open end of said fabric tube; and (f) engaging said first closure element on said first open end of said fabric tube with said second closure element to secure said fabric tube around said tubular body.

13. The method of covering a tubular pillow as claimed in claim 12, wherein said step of providing a second closure element to engage said first closure element involves mounting said second closure element circumferentially on said tubular body.

14. The method of covering a tubular pillow as claimed in claim 12, wherein said step of providing a second closure element to engage said first closure element involves mounting said second closure element on said second open end of said fabric tube.

15. A tubular pillow, comprising:

(a) a tubular body of a selected length and having a central tunnel;

(b) a cover tube for said tubular body having a length at least twice the selected length of said tubular body, said cover tube configured for passing through said central tunnel and passing outwardly around said tubular body; and (c) a first closure element on said tubular body and a second closure element on said cover tube in a manner to be mutually engaged when said cover tube is assembled to said tubular body.

* * * * *

UNITED STATES PATENT AND TRADEMARK OFFICE

CERTIFICATE OF CORRECTION

PATENT NO. : 6,041,458

DATED : March 28, 2000

INVENTOR(S) : Mark B. Vickers; Eric E. Vickers; Phreddie D. Popp

It is certified that error appears in the above-identified patent and that said Letters Patent is hereby corrected as shown below:

Column 2, line 35, change "covering, tube" to read --covering tube--.

Column 2, line 36, change "removeably, affixed" to read --removeably affixed--.

Column 3, line 56, correct "o n th e" to read --on the--.

Column 3, line 65, change "movement s" to read --movements--.

Column 5, line 4, change "7. and 4," to read -- 3 and 4,

Column 3, line 62, change "aim" to read --arm--.

Signed and Sealed this

Sixth Day of March, 2001

*Attest:*

Nicholas P. Godici

NICHOLAS P. GODICI

*Attesting Officer*

*Acting Director of the United States Patent and Trademark Office*